US005529565A

United States Patent [19]

Oetlinger

[11] Patent Number: 5,529,565

[45] Date of Patent: Jun. 25, 1996

[54] PRESSER ASSEMBLY

[76] Inventor: Frank E. Oetlinger, 1433 Fox La., Grafton, Wis. 53024

[21] Appl. No.: 183,991

[22] Filed: Jan. 18, 1994

[51] Int. Cl.[6] ..... B65H 35/00

[52] U.S. Cl. ..... 493/468; 493/472; 493/480; 493/342; 493/373; 225/105; 225/106

[58] Field of Search ..... 493/82, 83, 342, 493/373, 468, 472, 480; 225/105, 106, 103, 104; 83/175

[56] References Cited

U.S. PATENT DOCUMENTS

| | | | |
|---|---|---|---|
| 1,071,959 | 9/1913 | Schoenfeld | 83/175 |
| 1,404,239 | 1/1922 | Seybold . | |
| 1,911,742 | 5/1933 | Berry . | |
| 2,413,999 | 1/1947 | Shaner | 164/87 |
| 3,794,228 | 2/1974 | Colwill | 225/105 |
| 3,964,655 | 6/1976 | Kotaro | 225/105 |
| 4,171,081 | 10/1979 | Vossen et al. | 225/97 |
| 4,243,166 | 1/1981 | Vossen et al. | 225/1 |
| 4,248,370 | 2/1981 | Schroter | 225/97 |
| 4,488,466 | 12/1984 | Jones | 225/105 |
| 4,493,234 | 1/1985 | Ziegler | 83/175 |
| 4,767,482 | 8/1988 | Diez | 83/175 |

FOREIGN PATENT DOCUMENTS

| | | |
|---|---|---|
| 593131 | 11/1977 | Canada . |
| 391299 | 10/1990 | European Pat. Off. . |
| 2682633 | 4/1993 | France . |
| 2022951 | 1/1971 | Germany . |
| 2825631 | 1/1979 | Germany . |
| 3033648 | 4/1982 | Germany . |

*Primary Examiner*—Jack W. Lavinder
*Attorney, Agent, or Firm*—Andrus, Sceales, Starke & Sawall

[57] ABSTRACT

A presser assembly is provided for supporting carton blanking scrap during a blanking operation. The presser assembly includes a presser rail having a first end mounted to a guide cylinder and a second end mounted to a second guide cylinder such that each end of the presser rail is vertically movable independent of the opposite end. This, in turn, prevents jamming of the presser assembly during the blanking operation.

26 Claims, 4 Drawing Sheets

PRESSER ASSEMBLY

BACKGROUND OF THE INVENTION

This invention relates to a blanking operation, and in particular, to a presser assembly for supporting carton blanking scrap during a blanking operation.

In the manufacture of cartons, small sheets of material are cut out of larger sheets. These smaller sheets are known as carton blanks which, in turn, are formed into boxes. The blanks are formed during a process known as a blanking operation.

In a blanking operation, the blanks are cut, but not removed, from the large sheet of material. After the blanks have been cut, the sheet is positioned over a frame for support. The frame includes large openings which correspond in size and in position to the carton blanks previously cut. Below the frame is a mechanism for stacking the blanks.

In order to knock the carton blanks from the sheet of material and hold the scrap material, a presser assembly is used. The presser assembly includes a support tool having a presser member and a presser rail depending therefrom. The presser rail is biased away from the support tool. As the support tool is lowered, the presser rail engages the sheet of material such that the large sheet of material is secured between the presser rail and the frame. The support tool continues to be lowered such that the presser member engages the carton blanks and knocks the blank out of the sheet of material. The carton blanks fall onto a stacking mechanism wherein the blanks are stacked.

If a carton blank is not completely knocked out from the sheet of material, it is possible that the carton blank scrap may be forced by the presser member onto the stacking mechanism. In addition, if the presser rail does not adequately hold the carton blanking scrap, the scrap may fall onto the stacking mechanism. A carton blanking scrap in the stacking mechanism may jam the mechanism thereby causing downtime, and hence, expense.

In order to securely hold the carton blank scrap, the present day presser rails are interconnected to the support tool by a plurality of guide cylinders. Each guide cylinder biases the presser rail away from the support tool. This gives the presser rail a certain amount of flexibility when engaging the carton blanking scrap. However, even with this limited flexibility, present day presser rails have been found to be inadequate.

Therefore, it is the primary object and feature of this invention to provide a presser assembly having a presser rail which securely holds carton blanking scrap during a blanking operation.

It is a further object and feature of the present invention to provide a presser assembly having a presser rail which is durable and maintains its shape over an extended period of time.

It is still a further object and feature of the present invention to provide a presser assembly which is easy to assemble and easy to mount to standard blanking operation machinery.

SUMMARY OF THE PRESENT INVENTION

In accordance with the present invention, a presser assembly is provided for supporting carton blanking scrap during a blanking operation. The presser assembly includes a presser rail having a first end pivotably mounted to a first guide cylinder and a second end mounted to a second guide cylinder such that each end of the presser rail is independently, vertically movable during a blanking operation.

Each cylinder includes a housing which is mounted to a support. A guide member, telescoped within the housing, is interconnected to the housing by a stem mounted to a clevis. The clevis, in turn, is mounted to the presser rail. A spring is placed about the stem such that one end engages a bushing within the housing so as to bias the presser rail away from the support member, Each clevis includes first and second side walls, Each side will has an aperture which is in horizontal and vertical alignment with the other aperture. A pin extends through the vertically and horizontally aligned apertures in the clevis and a portion of the presser rail in order to interconnect the rail to each cylinder. The apertures in the clevis attached to one end of the presser rail are circular while the apertures in the other clevis are generally oblong in shape. The shape of the apertures allows each end of the presser rail to move vertically and move independently of the other end.

BRIEF DESCRIPTION OF THE DRAWINGS

The drawings furnished herewith illustrate a preferred construction of the present invention in which the above advantages and features are clearly disclosed as well as others which will be readily understood from the following description of the illustrated embodiment, In the drawings.

DESCRIPTION OF THE ILLUSTRATED EMBODIMENT

Figure 1:
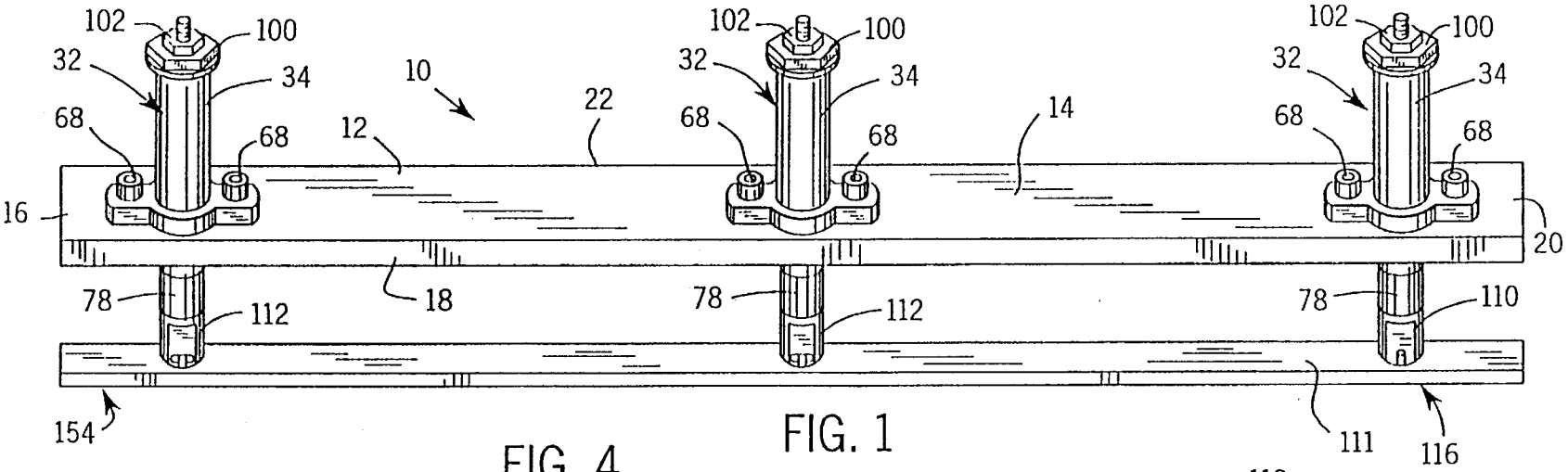
FIG. 1 is an isometric view of a presser assembly of the present invention.

Referring to FIG. 1, a presser assembly in accordance with the present invention is generally designated by the reference number 10. The presser assembly 10 includes a support 12 which is moved vertically during a blanking operation. As shown in FIG. 1, the support 12 is an elongated member having a first, upward face 14 and a second, downward face 15, FIG. 9. Each face is connected by four sides 16, 18, 20, and 22. In addition, each face is interconnected by an aperture 24 extending through support 12. The aperture is defined by a circular side wall 26 which engages face 14 at edge 28 and engages the downward face 15 at edge 50. Aperture 24 is provided in support 12 to facilitate the mounting of a cylindrical guide cylinder 52 to the support 12.

Referring to FIGS. 2, 3, 9 and 10, the cylindrical guide cylinder 52 includes a housing 54 for mounting to support 12. The housing 34 includes a tubular body portion 36 and shoulder portion 38 extending outwardly therefrom. Tubular portion 56 includes a cavity 40 defined by circular wall 42. A passage 44 defined by cylindrical wall 46 communicates with cavity 40. Walls 42 and 46 are joined by a flat, circular shoulder 47.

Shoulder portion 38 of housing 34 includes a first arm 50 and second arm 52 interconnected by a neck portion 54 about the periphery of tubular portion 36. Each arm 50, 52 has an upper surface 56 and a lower surface 58. Each surface 56 and 58 is interconnected by a circular wall 60 which defines a bolt passage 62. In order to connect housing 34 to support 12, bolts 64 extend through bolt passage 62 in each arm 50, 52 of the housing 34. The bolts 64 are threaded into bolt receipt apertures 66 in the support 12. Each bolt 64 has a head 68 having a diameter greater than that of each bolt passage 62 in order to prevent housing 34 from sliding axially off bolts 64 when the bolts 64 are threaded into bolt receipt apertures 66.

Figure 4:
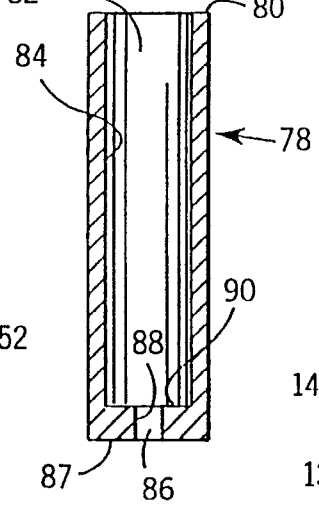
FIG. 4 is a cross-sectional view of a guide member of the guide cylinder shown in FIG. 2.
Figure 3:
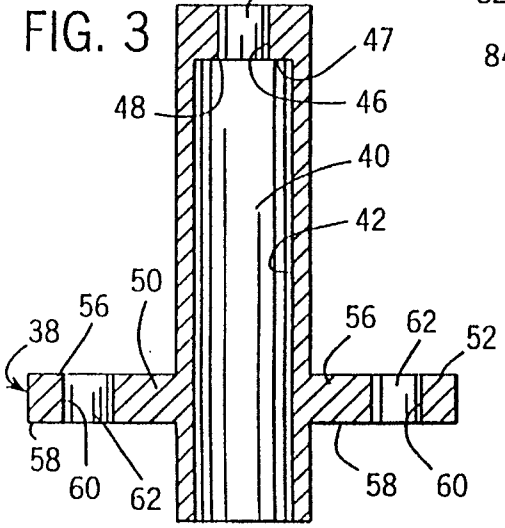
FIG. 3 is a cross-sectional view of a housing of the guide cylinder shown in FIG. 2.
Figure 9:
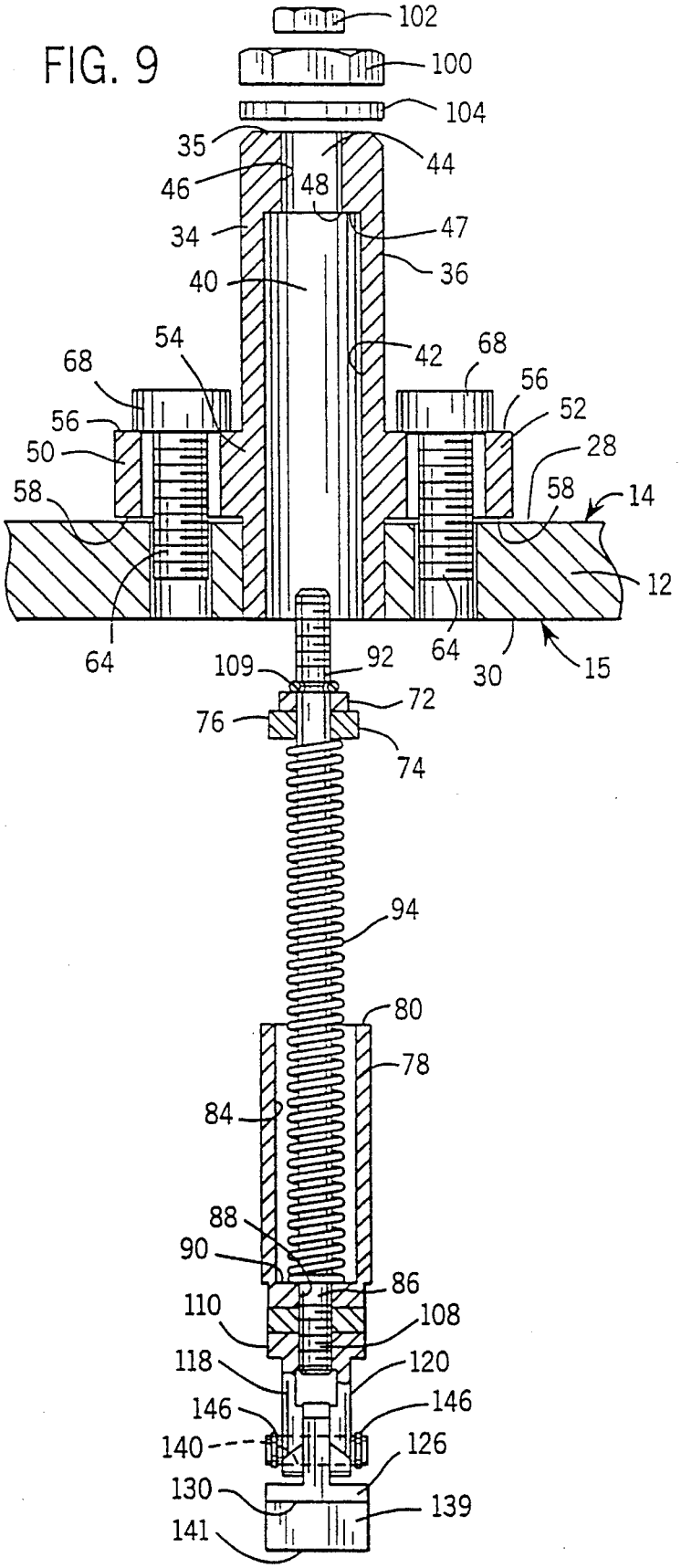
FIG. 9 is a partially exploded end view in cross section of a guide cylinder and a pressure rail of the present invention.
Figure 10:
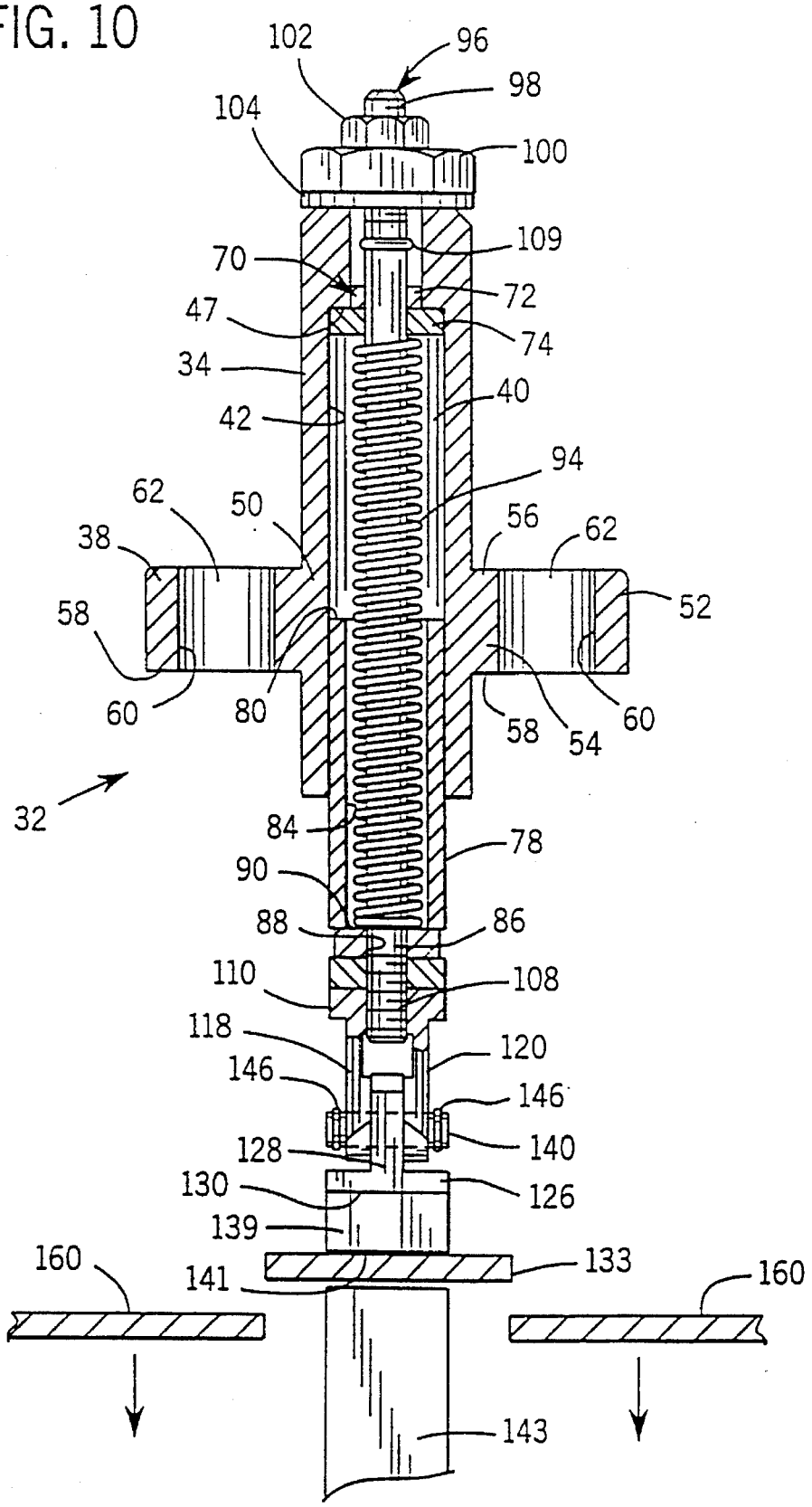
FIG. 10 is a cross-sectional end view of a guide cylinder and a presser rail of the present invention.

Referring to FIGS. 9 and 10, after mounting the housing 34 to support 12, a tubular guide member 78 is attached to housing 34. Cavity 40 in housing 34 is provided for axial receipt of tubular guide member 78. The tubular guide member 78 includes an upper end 80 orientated toward shoulder 47 of housing 34. Referring to FIG. 4, tubular guide member 78 also includes a cavity 82 defined by a cylindrical wall 84. Cavity 82 communicates with a passage 86 which is defined by cylindrical wall 88. Cylindrical walls 84 and 88 are joined by a flat circular shoulder 90.

Figure 2:
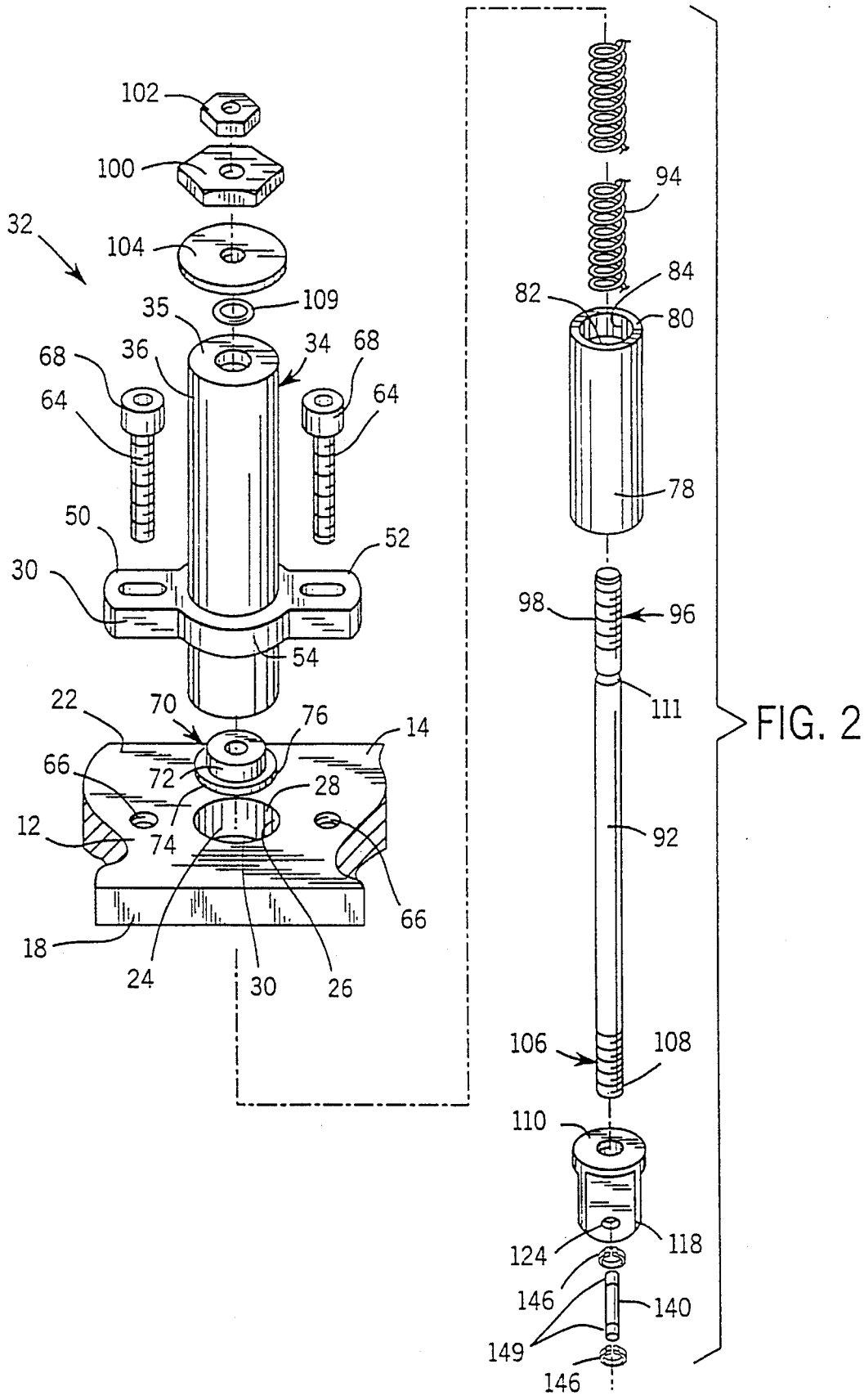
FIG. 2 is an exploded, isometric view of a guide cylinder of the presser assembly shown in FIG. 1.

As best seen in FIGS. 2, 9 and 10, in order to interconnect housing 34 to tubular guide member 78, stem 92 is provided. Stem 92 is inserted through passage 86 of tubular guide member 78, through a spring 94, and through a bushing 70. Bushing 70 includes a tubular body portion 72 and a head portion 74.

A snap ring 109, FIG. 9, may be placed in groove 111 about the circumference of stem 92 in order to limit the axial distance tubular guide member 78 may be biased away from bushing 70. This, in turn, facilitates the connecting of the tubular member to 78 to the housing 34. After connecting the tubular member 78 to presser rail 114, as hereafter described, snap ring 109 maintains spring 114 and bushing 70 on stem 92 when inserting stem 92 through passage 44 in housing 34. As stem 92 and bushing 70 are axially slid into cavity 40, the upper surface 76 of the head portion 74 of bushing 70 engages shoulder 47 of housing 34 and a first end 96 of stem 92 extends through passage 44 in housing 34. First end 96 of stem 92 includes threads 98 for receipt of nuts 100 and 102 to prevent stem 92 from sliding back through passage 44. A washer 104 may be placed between the upper portion 35 of housing 34 and nut 100.

A second end 106 of stem 92 also includes threads 108 to facilitate mounting the stem 92 to a clevis 110. When assembled, spring 94 axially bears against head 74 of bushing 70 and against shoulder 90 in tubular guide member 78 so as to bias tubular guide member 78 away from bushing 70. When interconnected to housing 34 and tubular guide member 78, stem 92 limits the axial distance tubular guide member 78 may be biased away from bushing 70.

There are two types of clevises for use with the presser assembly 10 of the present invention. Each clevis 110, 112 is used to interconnect the guide cylinder 32 to the presser rail 114. First clevis 110 is used to interconnect guide cylinder 32 to a first end 116, FIG. 1, of the presser rail 114. First clevis 110 includes first and second side walls 118, 120 which depend from a cylindrical body portion 122. Each side wall 118, 120 includes an aperture 124 which is horizontally and vertically aligned with the aperture on the opposing side wall. Aperture 124 in clevis 110 at the end 116 of presser rail 114 is generally circular in shape.

Figure 5:
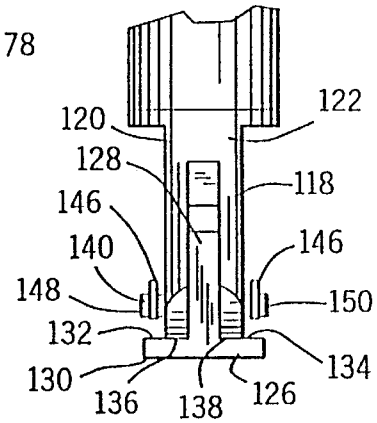
FIG. 5 is an end view of a portion of the presser assembly of FIG. 1.

As best seen in FIG. 5, presser rail 114 is generally T-shaped. The presser rail 114 includes a pressing portion 126 and a connection portion 128. Pressing portion 126 has a lower surface 130 for engaging the scrap of material 133 and a pair of upper surfaces 132, 134 which engage lower surfaces 136 and 138, respectively, of clevis 110 when presser rail 114 is pivotally mounted to clevis 110. In the alternative, a rubber pad 139, FIGS. 9–10, may be affixed to lower surface 130 of presser rail 114. The rubber pad 139 includes a pressing surface 141 for engaging the scrap material and holding the scrap 133 between the pressing surface 141 and a frame 143.

Figure 8:
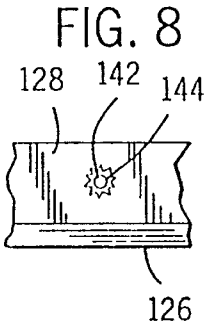
FIG. 8 is a side elevation view of a portion of a presser rail of the presser assembly shown in FIG. 1.
Figure 7:
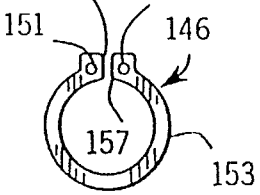
FIG. 7 is an isometric view of a lock ring for mounting a guide cylinder to the presser rail as shown in FIG. 5.

In order to interconnect presser rail 114 to clevis 110, connection portion 128 is positioned between side walls 118 and 120. A pin 140 is slid through aperture 124 in each side wall 118, 120 of clevis 110 and through aperture 142 in connection portion 128 of presser rail 114. When first clevis 110 is interconnected to the connection portion 128 of presser rail 114, pin 140 in circular aperture 124 prevents horizontal movement of presser rail 114 with respect to guide cylinder 32. As best seen in FIG. 8, aperture 142 in connection portion 128 of presser rail 114 is circumferentially supported by insert 144 in order to reinforce aperture 142. In order to prevent pin 140 from sliding through one or both of the side walls 118, 120, a lock ring 146, FIGS. 5, 7 and 9, is placed in a groove 149, FIG. 2, on each end 148, 150 of pin 140. Lock ring 146 is generally circular in shape and has a small opening 151 at each end of a wirelike body portion 153. The tips of a needle nose pliers may be inserted into openings 151 in order to separate ends 155, 157 of body portion 153 so as to allow lock ring 146 to be placed over ends 148, 150 of pin 140 and into grooves 149.

Figure 6:
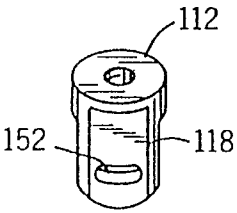
FIG. 6 is an isometric view of a clevis having an oblong opening in each side wall of the presser assembly shown in FIG. 1.

In order to interconnect the remaining cylindrical guide members 32 to presser rail 114, second clevis 112, FIG. 6, is used. Like first clevis 110, second clevis 112 is threaded onto end 106 of stem 92. Clevis 112 is identical to clevis 110 except that aperture 124 is replaced with an oblong opening 152 in each side wall 118, 120. Identical parts of clevises 110 and 112 will be identified by the same reference characters. Each oblong opening 152 is horizontally and vertically aligned with the other oblong opening 152 in the opposing side wall. Second clevis 112 is connected by pin 140 and by lock ring 146 to presser rail 114 in the same manner as the first clevis 110 is connected to presser rail 114.

By placing an oblong opening 152 in the second clevis 112, pin 140 may slide horizontally in oblong opening 152 as each end 116, 154, of presser rail 114 moves vertically. As a result, ends 116, 154, of presser rail 114 may move vertically each in unison or independently of the opposite end of the presser rail 114. This, in turn, increases the flexibility of the presser rail 114 when engaging a non-planar sheet of web material. As a result, the carton blanking scrap is more adequately supported when the blanks 160, FIG. 10, are knocked out of the large sheet of material. This, in turn, prevents the scrap 133 from jamming the blanking operation machinery.

It can be seen through the description of this invention that various alternative embodiments are possible without deviating from the scope and spirit of this invention as set forth in the appended claims.

I claim:

1. A presser assembly for supporting carton blanking scrap during a blanking operation, comprising:

a presser rail having a first end pivotally mounted to a first guide cylinder and a second end mounted to a second guide cylinder such that each end of the presser rail may move vertically independent from the other end.

2. The presser assembly of claim 1 wherein the first guide cylinder comprises:

a housing mounted to a support;

a guide telescoped within the housing, the guide and the housing interconnected by a stem having a first end mounted to a clevis;

means for mounting the clevis to the presser rail; and means for biasing the presser rail away from the support.

3. The presser assembly of claim 2 wherein the clevis includes first and second sidewalls, each sidewall having an aperture which is in horizontal and vertical alignment with the other aperture.

4. The presser assembly of claim 3 wherein the presser rail includes a connection member extending therefrom, the connection member having a first aperture extending therethrough, the aperture being vertically and horizontally aligned with each aperture and each sidewall of the clevis when the presser rail is pivotally mounted to the first guide cylinder.

5. The presser assembly of claim 4 wherein the presser rail is pivotally mounted to the first guide cylinder by a pin extending through the vertically and horizontally aligned apertures in the clevis and the connection member extending through the presser rail.

6. The presser assembly of claim 1 wherein the second cylinder comprises:

a housing mounted to a support;

a guide telescoped within the housing, the guide and the housing interconnected by a stem having a first end mounted to a clevis;

means for mounting the clevis to the presser rail; and means for biasing the support rail away from the presser rail.

7. The presser assembly of claim 6 wherein the clevis includes first and second sidewalls, each sidewall having an aperture which is in horizontal and vertical alignment with the other aperture.

8. The presser assembly of claim 7 wherein each aperture is generally oblong in shape.

9. The presser assembly of claim 7 wherein the presser rail includes a connection member extending therefrom, the connection member having a first aperture extending therethrough, the aperture being vertically and horizontally aligned with each aperture and each sidewall of the clevis such that the second end of the presser rail will move vertically in response to pivotal movement of the first end of the presser rail.

10. The presser assembly of claim 9 wherein the presser rail is mounted to the second guide cylinder by a pin extending through the vertically and horizontally aligned apertures in the clevis and the connection member of the presser rail.

11. A presser assembly for supporting carton blanking scrap during a blanking operation, comprising:

a support;

a presser rail connected to the support for engaging a carton blanking scrap, the presser rail being vertically and pivotally movable to prevent jamming of the presser assembly during a blanking operation; and means for interconnecting the presser rail to the support including a first guide cylinder pivotally mounted to a first end of the presser rail and fixed to the support and a second guide cylinder pivotally mounted to a second end of the presser rail and fixed to the support, each guide cylinder biasing the presser rail away from the support.

12. The presser assembly of claim 11 wherein each cylinder includes a clevis, each clevis pivotably mounted to the presser rail.

13. The presser assembly of claim 12 wherein each clevis is pivotably mounted to the presser rail by a pin extending through the clevis and the presser rail.

14. The presser assembly of claim 12, wherein each clevis includes first and second side walls, each side wall of the clevis of-the first guide cylinder having an aperture which is in horizontal and vertical alignment with the other aperture, each side wall of the clevis of the second guide cylinder having an oblong opening extending therethrough which is in horizontal and vertical alignment with the other oblong opening.

15. The presser assembly of claim 14 wherein the means for mounting the clevis of the first guide cylinder to the presser rail includes a pin extending through each aperture and the presser rail.

16. The presser assembly of claim 15 wherein the means for pivotally mounting the clevis of the second guide cylinder to the presser rail includes a pin extending through each oblong opening and the presser rail, the pin horizontally slidable within the oblong openings in response to pivotable movement of the first end of the presser rail.

17. The presser assembly of claim 13 wherein each guide cylinder comprises:

a housing mounted to the support rail;

a guide telescoped within the housing, the guide and the housing interconnected by a stem having a first end mounted to a clevis;

means for interconnecting the clevis to the presser rail; and means for biasing the presser rail away from the support member.

18. The presser assembly of claim 17 wherein the means for pivotably mounting the clevis of the second guide cylinder to the presser rail includes a pin extending through each oblong opening and the presser rail, the pin horizontally slidable in each oblong opening in response to vertical movement of the second end of the presser rail.

19. The presser assembly of claim 17 wherein the means for biasing the presser rail away from the support member includes a bushing within the housing; and a spring positioned about the stem, the spring having a first end engaging the bushing and a second end engaging the guide so as to bias the guide away from the bushing.

20. The presser assembly of claim 19 wherein the stem extends through the guide and the housing.

21. The presser assembly of claim 20 wherein the stem includes an end outside of the housing.

22. The presser assembly of claim 21 further comprising a means for maintaining the end of the stem outside of the housing.

23. The presser assembly of claim 22 wherein the means for maintaining the end of the stem outside of the housing includes a nut threaded on the end of the stem.

24. The presser assembly of claim 19 further comprising a means for maintaining the spring and the bushing on the stem.

25. The presser assembly of claim 24 wherein the means for maintaining the spring and the bushing on the stem includes a snap ring placed about the stem, the snap ring engagable with the bushing.

26. The presser assembly of claim 11 wherein the presser rail includes a pad for engaging the carton blanking scrap.

* * * * *

UNITED STATES PATENT AND TRADEMARK OFFICE

CERTIFICATE OF CORRECTION

PATENT NO. : 5,529,565

DATED : June 25, 1996

INVENTOR(S) : Frank E. Oetlinger

It is certified that error appears in the above-indentified patent and that said Letters Patent is hereby corrected as shown below:

IN THE CLAIMS:

| | |
|---|---|
| CLAIM 14<br>Col. 6, line 21<br>(Claim 17, line 3) | After the word "of" delete "-" and insert a space. |

Signed and Sealed this

Seventh Day of January, 1997

*Attest:*

*Attesting Officer*

BRUCE LEHMAN

*Commissioner of Patents and Trademarks*